United States Patent [19]

Nakahara et al.

[11] 4,267,201

[45] May 12, 1981

[54] MAGNETIC BRUSH DEVELOPMENT APPARATUS AND METHOD

[75] Inventors: Tosio Nakahara; Hidetoshi Yano; Nobuo Kasahara, all of Yokohama, Japan

[73] Assignee: Ricoh Company, Ltd., Japan

[21] Appl. No.: 85,490

[22] Filed: Oct. 17, 1979

[30] Foreign Application Priority Data

Oct. 20, 1978 [JP] Japan ..... 53-129176
Oct. 20, 1978 [JP] Japan ..... 53-129177

[51] Int. Cl.[3] ..... B05D 1/04; B05D 1/06; B05D 5/00

[52] U.S. Cl. ..... 427/27; 118/658; 118/668; 427/47

[58] Field of Search ..... 427/47, 27; 118/658, 118/668

[56] References Cited

U.S. PATENT DOCUMENTS 3,654,902 4/1972 Hakanson ..... 118/658

*Primary Examiner*—Bernard D. Pianalto
*Attorney, Agent, or Firm*—McGlew and Tuttle

[57] ABSTRACT

A magnetic brush development apparatus comprises a developer application roller and a development roller. When development is stopped, the developer application roller is stopped so that the supply of developer to the development roller is stopped. Normally, the development roller is continuously rotated or when development is stopped, the developer application roller is stopped first and after a while the rotation of the development roller is stopped.

4 Claims, 2 Drawing Figures

MAGNETIC BRUSH DEVELOPMENT APPARATUS AND METHOD

BACKGROUND OF THE INVENTION

The present invention relates to a magnetic brush development apparatus for use with an electrophotographic copying machine or electrostatic recording apparatus.

The magnetic brush development apparatus is an apparatus for attracting powder-like developer containing magnetic powder onto a development roller to form a magnetic brush which simulates the fibers of a brush thereon, and for bringing the magnetic brush into contact with a latent electrostatic image formed on the surface of a photoconductor or of a recording member, so that the latent electrostatic image is developed. Usually, the development roller comprises a rotatable non-magnetic sleeve with an internally disposed stationary magnet having a plurality of magnetic poles on its peripheral surface.

It is particularly important that the development roller attracts the developer to its surface and brings the magnetic brush formed on its surface into contact with the surface of a photoconductor only during development, and moves the developer away from the surface of the photoconductor when development is not performed. Particularly in the case of multi-color development in color copying apparatus, when a specific latent electrostatic image is developed by a specific color developer, other color developers must be precluded from being brought into contact with the electrostatic image. Otherwise, the developed image will be disturbed and smeared with other color developers.

In order to keep the developer on the development roller off a development surface when development is not performed, a variety of methods have been proposed. In one method, the development roller is designed so as to be moved away from the surface of a photoconductor when development is not performed. A shortcoming of this method is that a complicated mechanism is required in order to keep the gap between the development roller and the surface of the photoconductor constant and its operation is unstable and its cost is too high to be used. Furthermore, movable members for use in the mechanism are generally large in size and therefore require a great space for moving the development roller away from the photoconductor in a copying machine, so that the use of such mechanism is disadvantageous for reducing the size of the copying machine. Furthermore, this mechanism requires a number of members be disposed around the photoconductor, so that there is a risk that the surface of the photoconductor can be scratched or damaged by the members when the photoconductor is exchanged with a new photoconductor.

In another conventional method, a blade for scraping developer from the surface of a development roller is disposed in contact with the surface of the development roller, and, when development is not performed, the development roller is rotated in a reverse direction so that the developer on the development roller is removed by the blade. In a further conventional method, a blade for regulating the amount of developer on a development roller is disposed in a detachable manner from the surface of the development roller, and, when development is not performed, the blade is brought into contact with the surface of the development roller to scrape developer from the development roller. In the former method, a complicated and expensive drive source is required and a great torque is applied to the development roller, so that a copying machine using this method is great in size, if the necessary drive and control mechanisms are included. In the latter method, the necessary apparatus is rather simple in the mechanism and economical. However, there is a limitation to the attachment position of the blade with respect to the development roller, which makes the necessary mechanism complicated and reduces operational stability in practice. In this method, it is proposed to apply a bias voltage to a development roller in order to improve development efficiency. In this case, however, it is extremely difficult to insulate the blade electrically and a more complicated mechanism is required in order to overcome this problem. Further, since the blade is brought directly into contact with the surface of the development roller, the development roller may be smeared, damaged or charged triboelectrically, having adverse effects on development. The adverse effects cannot be ignored. Therefore, in order to overcome these problems, there are not many choices in the suitable materials for the development roller and the blade and the suitable methods for surface treatment of the development roller and the blade. As a result, this method is concluded to be an expensive method. The above-mentioned shortcomings have adverse effects on the quality of developed images and the overall life and reliability of a copying machine.

SUMMARY OF THE INVENTION

It is therefore an object of this invention to provide a magnetic brush development apparatus capable of securely feeding developer from a developer application roller to a development roller and stopping the supply by a simple mechanism.

Another object of the invention is to provide an economical magnetic brush development apparatus in which the scattering of developer therefrom and deterioration of developer are held back.

In one embodiment of a magnetic brush development apparatus according to the invention, there are provided a developer container for holding powder developer containing magnetic powder therein, a developer application roller for holding the developer thereon and transporting the developer onto the development roller, and a development roller for receiving the developer from the developer application roller and transporting the same to a development section of a copying machine, and the rotation of the developer application roller is stopped when development is not performed. The development roller is always rotated regardless of whether or not development is performed.

According to this embodiment, since the rotation of the developer application roller is stopped when development is not performed so that the developer is not supplied to the development roller, the change-over control for supplying and non-supplying of the developer to the development roller is simple and secure, and, since the developer is not circulated within the developer container when development is not performed, the scattering of the developer is prevented and the mechanical and physical life of the developer is not shortened. Furthermore, since the rotation control of the developer application roller is simple, the operation change-over response from development to undevelopment and vice versa is so quick that the load torque and the number of parts can be reduced and therefore the copying apparatus can be constructed inexpensively.

In another embodiment of a magnetic development apparatus of the invention, in the above-mentioned magnetic development apparatus, the rotation of the developer application roller is first stopped when development is stopped and, after a while, the development roller is stopped.

According to this embodiment, when the copying process is moved from development onto undevelopment, the rotation of the developer application roller is first stopped and the development roller is continuously rotated for a while and the developer remaining on the development roller is scraped from the development roller by a scraper and the development roller is then stopped. Therefore, the developer is not brought into contact with the surface of the photoconductor when development is not performed and the duration of the rotation of each roller is reduced to the minimum so that the deterioration and change of electrostatic characteristics of the developer, which may be caused by fatigue and destruction of the developer, are small and the developer is scarcely scattered or mixed with the other developers in the other development apparatuses in the case of multi-color development. Furthermore, since the developer scarcely remains on the development roller when development is not performed, the developer is scarcely scattered and accordingly the portions near the photoconductor are scarcely smeared by the developer when the photoconductor is exchanged with a new photoconductor. Furthermore, when development is not performed, most of the developer is recovered into the developer container. Therefore, the area of the developer exposed to the open air is small and the time the developer is exposed to the air is short so that the developer is less contaminated with dusts and accordingly the electrostatic characteristics of the developer need be changed less. Furthermore, since all of the rollers are not rotated at one time, the necessary drive torque is small and vibrations and noises are also small, so that the durability of the copying machine is improved.

It is a further object of the invention to provide a process for attracting a powder developer containing magnetic powder onto a development roller to form a magnetic brush for contact with an electrostatic image on the surface of one of a photoconductor member and a recording member, the process being of the type including the steps of magnetically attracting the powder into contact with a moving non-magnetic outer surface of a developer application roller having an internally disposed stationary magnet and transferring the developer from the outer surface to the development roller, the improvement which includes the steps of terminating the rotation of the developer application roller when development is not performed and rotating the development roller irrespective of whether development is performed or not. A further embodiment of the inventive process includes the step of terminating rotation of the development roller after the developer application roller rotation is terminated.

It is a further object of the invention to provide a magnetic brush development apparatus which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
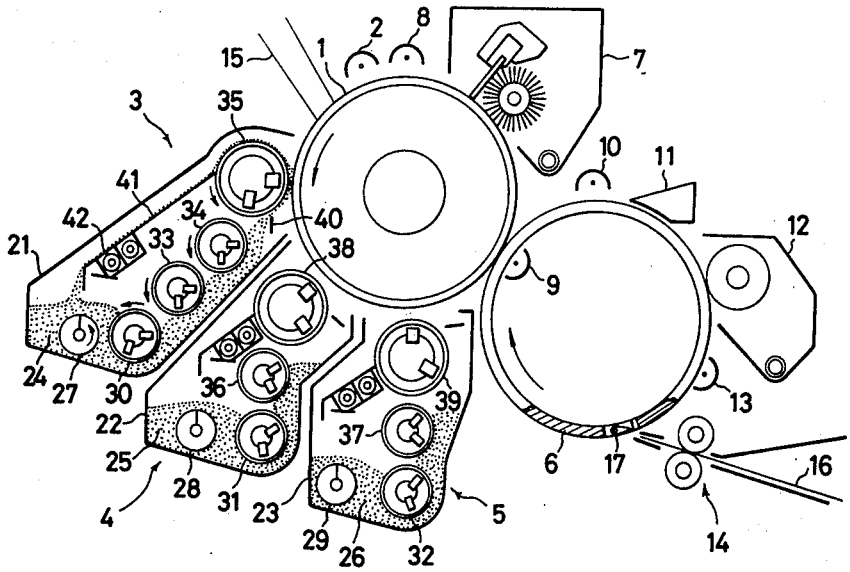
FIG. 1 is a diagrammatical view of an electrophotographic color copying machine in which the invention is employed.

Referring to FIG. 1, there is shown a diagrammatical view of an electrophotographic color copying machine in which the invention is employed. In FIG. 1, around a photoconductor drum 1 having a photoconductive layer on its peripheral surface, and more specifically in the counterclockwise direction around the photoconductor drum 1, there are arranged a charging corona charger 2, a yellow development apparatus 3, a magenta development apparatus 4, a cyan development apparatus 5, an image transfer drum 6, a cleaning apparatus 7 and a quenching corona charger 8. The image transfer drum 6 consists essentially of a cylinder made of a dielectric sheet, whose diameter is equal to the diameter of the photoconductor drum 1. The image transfer drum 6 is rotated clockwise at the same peripheral speed as that of the photoconductor drum 1 in contact with the surface of the photoconductor drum 1. Inside of the image transfer drum 6 at a portion where the image transfer drum 6 and the photoconductor drum 1 are in contact with each other, there is disposed an image transfer corona charger 9. Outside of the image transfer drum 6, there are disposed a corona charger 10 for quenching charges on a transfer sheet, a sheet separation member 11, a cleaning apparatus 12, a corona charger 13 for quenching charges on the image transfer drum 6, and a transfer sheet transportation apparatus 14 for transferring a transfer sheet 16 in the rotating direction of the image transfer drum 6.

When the surface of the photoconductor drum 1 is charged to a predetermined polarity by the charging corona charger 2, a light image 15 of an original, having passed through a blue filter and having a yellow color as its main color component, is projected from an exposure optical system (not shown) to the surface of the photoconductor drum 1 and electric charges on the drum 1 are conducted away from its surface, depending upon the lightness of the projected light image 15, so that a latent electrostatic image is formed on the surface of the photoconductor drum 1. The thus formed latent electrostatic image is developed with a yellow developer supplied from the yellow development apparatus 3. When the yellow development is performed, development is not performed by the magenta development apparatus 4 and the cyan development apparatus 5. In the meantime, a transfer sheet 16 is transported onto the image transfer drum 6 in synchronism with the timing of the image formation on the drum 1 and is held firmly by a clamp apparatus 17 and transported, held on the surface of the image transfer drum 6. The leading edge of the transfer sheet 16 is in conformity with the leading edge of the yellow image formed on the drum 1 at a position corresponding to the position of the image transfer corona charger 9 and when the image transfer sheet 16 passes under the image transfer corona charger 9, the yellow image is transferred to the transfer sheet 16. After the image transfer, the residual toner on the photoconductor drum 1 is removed by the cleaning apparatus 7 and the residual charges on the surface of the drum 1 are quenched by the charge quenching corona charger 8 and thereafter the surface of the drum 1 is again charged uniformly by the charging corona charger 2 and the next image formation process is started.

In the next image formation process, a light image of the same original, passing through a green filter, whose main color component is magenta, is projected from an exposure optical system (not shown) onto the surface of the uniformly charged photoconductor drum 1, so that a latent electrostatic image of a magenta component is formed on the drum 1. This latent electrostatic image is developed by the magenta development apparatus 4 so that a magenta image is formed on the photoconductor drum 1. In the meantime, the transfer sheet 16, to which the yellow image has been transferred, is subjected to charge quenching by the charge quenching corona charger 10 and makes one revolution while held on the image transfer drum 6, without any work being applied thereto by the sheet separation member 11, the cleaning apparatus 12 and the charge quenching corona charger 10, so that the transfer sheet 16 is superimposed on the magenta image formed on the photoconductor drum 1 and the magenta image is transferred onto the transfer sheet 16 in a manner to cover the yellow image of the transfer sheet 16 by the image transfer corona charger 9.

Likewise, in the next image formation process, a light image of the same original, passing through a red filter, whose main component is cyan, is projected onto the photoconductor drum 1 so that a latent electrostatic image is formed on the photoconductor drum 1. This latent electrostatic image is developed by the cyan development apparatus 5 and the developed image is superimposed on the magenta image of the transfer sheet 16 and is transferred to the transfer sheet 16. The transfer sheet 16 to which the cyan image has been transferred is subjected to charge quenching by the charge quenching corona charger 10 and is then separated from the image transfer drum 6 by the sheet separation member 11 and is transported into an image fixing station (not shown) where the transferred images are fixed to the transfer sheet 16. After the transfer sheet 16 has been separated from the image transfer drum 6, the developer remaining on the non-image areas on the surface of the image transfer drum 6 is removed by the cleaning apparatus 12 and the residual charges on the image transfer drum 6 are quenched by the charge quenching corona charger 13.

Now the development apparatus, which are main portion of the invention, will be explained. Each development apparatus is a magnetic brush development apparatus. In the respective lower portions of developer containers 21, 22, 23, there are held two-component developers 24, 25, 26 comprising magnetic carriers and different color toners, respectively. In the respective lower portions of the developer containers 21, 22, 23, there are disposed spiral agitators 27, 28, 29, respectively, which are rotatable counterclockwise, and there are disposed first developer application rollers 30, 31 32 on the respective sides of the spiral agitators 27, 28, 29. In the yellow development apparatus 3, above the first developer applicator roller 30, there are disposed a second developer applicator roller 33, a third developer applicator roller 34 and a development roller 35, one above the other, in the upward direction. In the magenta development apparatus 4 and the cyan development apparatus 5, there are likewise disposed second developer applicator rollers 36, 37 and development rollers 38, 39, respectively. Each developer applicator roller and each development roller respectively comprise a non-magnetic outer sleeve which is rotated counterclockwise and a magnet disposed stationarily inside the non-magnetic sleeve. The magnet has plural magnetic poles and each magnetic pole is directed in a predetermined direction. The developers held in the respective development apparatuses are stirred by the agitators 27, 28, 29 so that each toner is triboelectrically charged to a polarity opposite to that of a latent electrostatic image by the friction between the toner and carrier particles. The toners and magnetic carriers which cling to each other by the triboelectric charging are magnetically attracted to the surfaces of the first developer application rollers 30, 31, 32 and carried upwards by the rotation of the first developer application rollers 30, 31, 32. Above the first developer application rollers 30, 31, 32, there are disposed the second developer applicator rollers 33, 36, 37, respectively in close proximity to the first developer application rollers 30, 31, 32. Therefore, the developers that have been carried by the first developer applicator rollers 30, 31, 32 are respectively transported to the second developer applicator rollers 33, 36, 37 and are carried upwards.

A feature of the invention is that each developer applicator roller and each development roller are driven separately and each development roller is always rotated irrespective of whether or not development is performed, while the rotation of each developer application roller is stopped when development is not performed. Therefore, when only yellow development is performed, without performing magenta development and cyan development, the agitator 27, the developer application rollers 30, 33, 34, and the development roller 35 are all rotated and the developer transported from third developer application roller 34 to the development roller 35 is brought into contact with a latent electrostatic image formed on the surface of the photoconductor drum 1 after the amount of the developer on the development roller 35 is appropriately reulated. In the meantime, in the magenta development apparatus 4 and the cyan development apparatus 5, only the development rollers 38, 39 are rotated, while each agitator and each developer application roller are stopped, so that the developers are not scooped up and therefore development is not performed in each of the magenta development apparatus 4 and the cyan development apparatus 5. Likewise, when magenta development is performed, each member of the magenta development apparatus 4 is in operation, while only the development rollers in the yellow development apparatus 3 and the cyan development apparatus 5 are rotated and the other members are all stopped, and the development process is performed in the same manner as mentioned above.

When development is performed, the developer that has been used for each development, remaining on each development roller in each development apparatus, is removed from each development roller by each of scrapers 41, 42, 43 which are disposed in proximity to each development roller and is returned into each developer container, so that the developer is circulated within each development apparatus. On the back side of each scraper, there is disposed a toner replenishing apparatus which replenishes fresh toner into the developer as the toner is consumed by development. The rotation control of each agitator and each developer applicator roller is performed by magnetic clutches and other members connected to a rotation shaft of each roller or of each non-magnetic sleeve.

Another embodiment of a magnetic development apparatus of the invention will now be explained.

When only the yellow development is performed and the magenta development and the cyan development are not peformed, the agitator 27 and each of the developer applicator rollers 30, 33, 34 are all rotated in the yellow development apparatus 3, while in the magenta development apparatus 4 and the cyan development apparatus 5, the rotation of each of the agitators, developer application rollers, and development roller is stopped. In the yellow development apparatus 3, a developer 24 in the developer container 21 is stirred by the agitator 27 and the toner in the developer 24 is triboelectrically charged to a polarity opposite to that of a latent electrostatic image by the friction between the toner and magnetic carriers. The toner and magnetic carriers which cling to each other by the triboelectric charging are magnetically attracted to the surface of the first developer application roller 30 and are carried upwards by the rotation of the first developer application roller 30. The developer carried upwards is then transferred to the second developer application roller 33 to the third developer application roller 34 to the development roller 35, and, after the amount of the developer 35 is regulated, the developer is brought into contact with a latent electrostatic image formed on the surface of the photoconductor drum 1 so that the latent electrostatic image is developed. After development, the developer remaining on the development roller 35 is removed from the development roller 35 by a scraper 41 and is caused to fall into the developer container 21 so that the developer is circulated in the development apparatus 3. As the toner is consumed by the development, fresh toner is replenished by the amount corresponding to that of the consumed toner by the toner replenishment apparatus 42, which is disposed on the back side of the scraper 41, so that the toner concentration of the developer is maintained appropriately.

After development, the agitator 27 and each of the developer applicator rollers 30, 33, 34 are first stopped. Since the developer is not supplied to the development roller 35 any longer, the development roller 35 is continuously rotated, attracting the developer thereto that has already been supplied to its surface and neighbor, and the developer is scraped from the surface of the development roller 35 by the tip of the scraper 41. When most of the developer or all of the developer has been removed from the surface of the development roller 35, the rotation of the development roller 35 is stopped. The period of time from the stopping of the developer application rollers 30, 33, 34 to the stopping of the development roller 35 is determined, taking into the consideration the time required for most of the developer to be removed from the surface of the development roller 35 and the time before magenta development is started. In the meantime, the agitator 28 and each of the developer application rollers 31, 36 begin to be rotated in the magenta development apparatus 4 and the developer is stirred and scooped up and the magenta development is followed. Thereafter, the rotation control of the agitator 28, the developer application rollers 31, 36 and the development roller 38 is performed. This rotation control is performed by a magnetic clutch and other members in accordance with input signals from a micro computer disposed in the copying apparatus.

Figure 2:
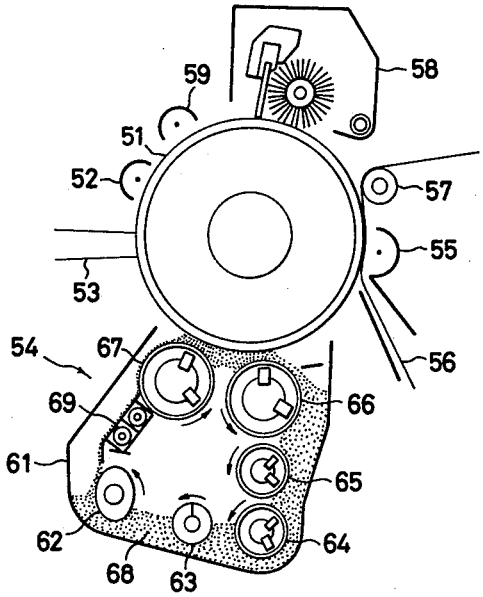
FIG. 2 is a diagrammatical view of an ordinary electrophotographic copying machine in which the invention is employed.

Referring to FIG. 2, there is shown a diagrammatical view of an ordinary electrophotographic copying machine for forming black images, in which another embodiment of a magnetic brush development apparatus according to the invention is employed. In the electrophotographic copying apparatus, as in the case of the previously mentioned color copier, the copying operation is started with the cleaning of a photoconductor drum 51. When cleaning the photoconductor drum 51, a better cleaning efficiency is obtained when the developer on the development roller 38 is not brought into contact with the surface of the photoconductor drum 51. Therefore, for this purpose, it is better to stop the supplying of the developer to the development roller 38 in the ordinary electrophotographic copying machine as well. When image is formed by utilizing part of a photoconductor drum, it is better that the developer does not come in contact with the surface of the photoconductor drum after development.

In the electrophotographic copying machine illustrated in FIG. 2, the surface of the photoconductor drum 51 is uniformly charged by a corona charger 52 and a light image 53 of an original is projected onto the surface of the photoconductor drum 51 so that a latent electrostatic image is formed on the photoconductor drum 51. The thus formed latent electrostatic image is developed by a development apparatus 54 and the developed image is then transferred to a transfer sheet 56 by a corona charger 55. After image transfer, the transfer sheet 56 is separated from the surface of the photoconductor drum 51 by a sheet separation roller 57 and the residual toner on the photoconductor drum 51 is removed from the photoconductor drum 51 by a cleaning apparatus 58 and the residual charges on the photoconductor drum 51 are quenched by a corona charger 59.

In the development apparatus 54, there are disposed a stirring member 62 comprising a shaft and a number of elliptic plates spaced and slantingly mounted on the shaft, a spiral agitator 63, and a first developer application roller 64, and above the first developer application roller 64, there are disposed a second developer application roller 65 and a second development roller 66, and beside the second development roller 66, there is disposed a first development roller. Each of the developer application rollers and each of the development rollers comprise a rotatable non-magnetic sleeve with an internally disposed stationary magnet.

A developer 68 stirred by the stirring member 62 and the agitator 63 is triboelectrically charged so that toner in the developer 68 is charged to a polarity opposite to that of carriers of the developer 68. The developer 68, carried upwards by each of the developer application rollers 64, 65, is transported to the second development roller 66 and is then transported to the first development roller 67 and is brought into contact with a latent electrostatic image on the photoconductor drum 51 at a position between the first development roller 67 and the second development roller 66. The developer on the first development roller 67 is removed from the surface thereof by a scraper 69 and is caused to fall into the developer container 61 and is then circulated within the developer container 61.

Also in this development apparatus, the two development rollers 67, 66 are always rotated after a main switch of the copying machine is turned on, irrespective of whether or not development is performed, and the stirring member 62, the agitator 63 and each of the developer application rollers 64, 65 are stopped when development is not performed. Alternatively, when development is stopped, the stirring member 62, agitator 63 and each of the developer application rollers 64, 65 are first stopped and after a while, each of the development rollers 66, 67 is stopped.

While the invention has been described in conjunction with specific embodiments, it is evident that many alternatives, modification and variations will be apparent to those skilled in the art in light of the foregoing description. Accordingly, it is intended to embrace all such alternatives, modifications and variations as fall within the spirit and broad scope of the appended claims.

What is claimed is:

1. In a process for attracting a powder developer containing magnetic powder onto a development roller to form a magnetic brush for contact with an electrostatic image on the surface of one of a photoconductor member and a recording member, the process being of the type including the steps of magnetically attracting the powder into contact with a moving non-magnetic outer surface of a developer application roller having an internally disposed stationary magnet and transfering the developer from said outer surface to the development roller, the improvement which comprises the steps of terminating the rotation of said developer application roller when development is not performed and rotating said development roller irrespective of whether development is performed.

2. The process of claim 1, further comprising the step of terminating rotation of said development roller after said developer application roller rotation is terminated.

3. A magnetic brush development apparatus for attracting a powder developer containing magnetic powder and transfering the developer for contact with an electrostatic image comprising: a container for holding the developer, a developer application roller rotatably mounted in said container for transporting said developer, said developer application roller including a movable non-magnetic outer sleeve and a stationary magnet disposed within said sleeve, a development roller rotatably mounted in said container adjacent said developer application roller for receiving the developer therefrom and transporting the developer for contact with the electrostatic image, means for continuously rotating said development roller whether or not development is performed and for stopping rotation of said developer application roller when development is not performed.

4. The apparatus of claim 3 further comprising means for first stopping rotation of said developer application roller and then, after a predetermined time, stopping rotation of said development roller.

* * * * *